US007118715B1

(12) United States Patent
Hedrick et al.

(10) Patent No.: US 7,118,715 B1
(45) **Date of Patent: *Oct. 10, 2006**

(54) STRIPPING PROCESS WITH DISPROPORTIONATELY DISTRIBUTED OPENINGS ON BAFFLES

(75) Inventors: Brian W. Hedrick, Des Plaines, IL (US); Thuy Khanh T. Nguyen, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/717,686

(22) Filed: Nov. 20, 2003

Related U.S. Application Data

(62) Division of application No. 09/990,244, filed on Nov. 21, 2001, now Pat. No. 6,780,308.

(51) Int. Cl.
*B01J 8/00* (2006.01)

(52) U.S. Cl. ..... 422/144; 422/228; 208/150; 208/151

(58) Field of Classification Search ..... 422/139–147; 208/150, 113, 151
See application file for complete search history.

(56) References Cited

U.S. PATENT DOCUMENTS

| | | | | |
|---|---|---|---|---|
| 2,440,620 | A | 4/1948 | Taff | 422/144 |
| 2,472,502 | A | 6/1949 | Tyson | 422/144 |
| 2,519,150 | A * | 8/1950 | Ostergaard | 208/151 |
| 2,541,801 | A | 2/1951 | Wilcox | 208/151 |
| 2,612,438 | A | 9/1952 | Murphree | 422/144 |
| 2,893,849 | A * | 7/1959 | Krebs | 422/143 |
| 2,994,659 | A | 8/1961 | Slyngstad et al. | 208/113 |
| 3,894,932 | A | 7/1975 | Owen | 208/74 |
| 4,220,623 | A | 9/1980 | Jahnke et al. | 422/144 |
| 4,364,905 | A | 12/1982 | Fahrig et al. | 422/144 |
| 4,414,100 | A | 11/1983 | Krug et al. | 208/153 |
| 4,419,221 | A | 12/1983 | Castagnos, Jr. et al. | 208/113 |
| 4,431,749 | A | 2/1984 | Hettinger, Jr. et al. | 502/68 |
| 4,481,103 | A | 11/1984 | Krambeck et al. | 208/120 |
| 4,500,423 | A | 2/1985 | Krug et al. | 208/161 |
| 4,541,922 | A | 9/1985 | Lomas et al. | 208/164 |
| 4,541,923 | A | 9/1985 | Lomas et al. | 208/164 |
| 4,605,491 | A * | 8/1986 | Haddad et al. | 208/161 |
| 4,871,446 | A * | 10/1989 | Herbst et al. | 208/152 |
| 4,927,606 | A * | 5/1990 | Cetinkaya et al. | 422/144 |
| 5,531,884 | A | 7/1996 | Johnson et al. | 208/150 |
| 6,740,227 | B1 * | 5/2004 | Hedrick | 208/113 |
| 2002/0008052 | A1 | 1/2002 | Hedrick | 208/113 |

* cited by examiner

*Primary Examiner*—Alexa Doroshenk Neckel
*Assistant Examiner*—Jennifer A. Leung
(74) *Attorney, Agent, or Firm*—John G. Tolomei; James C. Paschall

(57) ABSTRACT

A baffle-style stripper for an FCC process comprising sloped baffles in which a greater volumetric flow rate of stripping medium permeates openings in a bottom section of the baffle than through a top section of the baffle for low catalyst flux stripping operations. When low catalyst flux is used, the catalyst runs from baffle to baffle closer to the bottom edge of the baffle. Hence, more fluidization from stripping medium is concentrated near the lower edge of the baffle. The greater fluidization at the bottom section of the baffle is accomplished by providing greater opening area per baffle area in the lower section of the baffle than in the top section of the baffle.

6 Claims, 4 Drawing Sheets

STRIPPING PROCESS WITH DISPROPORTIONATELY DISTRIBUTED OPENINGS ON BAFFLES

CROSS-REFERENCE TO RELATED APPLICATION

This application is a Division of application Ser. No. 09/990,244 filed Nov. 21, 2001, now U.S. Pat. No. 6,780, 308, the contents of which are hereby incorporated by reference in its entirety.

BACKGROUND OF THE INVENTION

This invention relates to processes and apparatus for the fluidized contacting of catalyst with hydrocarbons. More specifically, this invention relates to processes and apparatus for stripping entrained or adsorbed hydrocarbons from catalyst particles.

DESCRIPTION OF THE PRIOR ART

A variety of processes contact finely divided particulate material with a hydrocarbon containing feed under conditions wherein a fluid maintains the particles in a fluidized condition to effect transport of the solid particles to different stages of the process. Catalyst cracking is a prime example of such a process that contacts hydrocarbons in a reaction zone with a catalyst composed of finely divided particulate material. The hydrocarbon feed fluidizes the catalyst and typically transports it in a riser as the catalyst promotes the cracking reaction. As the cracking reaction proceeds, substantial amounts of hydrocarbon, called coke, are deposited on the catalyst. A high temperature regeneration within a regeneration zone burns coke from the catalyst by contact with an oxygen-containing stream that again serves as a fluidization medium. Coke-containing catalyst, referred to herein as spent catalyst, is continually removed from the reaction zone and replaced by essentially coke-free catalyst from the regeneration zone. Fluidization of the catalyst particles by various gaseous streams allows the transport of catalyst between the reaction zone and regeneration zone. Methods for cracking hydrocarbons in a fluidized stream of catalyst, transporting catalyst between reaction and regeneration zones and combusting coke in the regenerator are well known to those skilled in the art of FCC processes. To this end, the art is replete with vessel configurations for contacting catalyst particles with feed and regeneration gas, respectively.

A majority of the hydrocarbon vapors that contact the catalyst in the reaction zone are separated from the solid particles by ballistic and/or centrifugal separation methods within the reaction zone. However, the catalyst particles employed in an FCC process have a large surface area, which is due to a great multitude of pores located in the particles. As a result, the catalytic materials retain hydrocarbons within their pores, upon the external surface of the catalyst and in the spaces between individual catalyst particles as they enter the stripping zone. Although the quantity of hydrocarbons retained on each individual catalyst particle is very small, the large amount of catalyst and the high catalyst circulation rate which is typically used in a modem FCC process results in a significant quantity of hydrocarbons being withdrawn from the reaction zone with the catalyst.

Therefore, it is common practice to remove, or strip, hydrocarbons from spent catalyst prior to passing it into the regeneration zone. Improved stripping brings economic benefits to the FCC process by reducing "delta coke". Delta coke is the weight percent coke on spent catalyst less the weight percent coke on regenerated catalyst. Reducing delta coke in the FCC process permits a lowering of the regenerator temperature. Consequently, more of the resulting, relatively cooler regenerated catalyst is required to supply the fixed heat load in the reaction zone. The reaction zone may hence operate at a higher catalyst-to-feed or catalyst-to-oil (C/O) ratio. The higher C/O ratio increases conversion which increases the production of valuable products. Accordingly, improved stripping results in improved conversion. A stripping operation that reduces the production of delta coke by 0.05 wt-% can lower the regenerator temperature by 8° to 11° C. (15° to 20° F.) and permit a C/O ratio increase in the range of 6%. The corresponding improvement in conversion yields 0.6 to 0.7 vol-% more gasoline as well also increasing the yield of desired light products. Additionally, stripping hydrocarbons from the catalyst also allows recovery of the hydrocarbons as products.

The most common method of stripping the catalyst passes a stripping gas, usually steam, through a flowing stream of catalyst, counter-current to its direction of flow. Such steam stripping operations, with varying degrees of efficiency, remove the hydrocarbon vapors which are entrained with the catalyst and adsorbed on the catalyst. Contact of the catalyst with a stripping medium may be accomplished in a simple open vessel as demonstrated by U.S. Pat. No. 4,481,103.

The efficiency of catalyst stripping is increased by using vertically spaced baffles to cascade the catalyst from side to side as it moves down a stripping apparatus and counter-currently contacts a stripping medium. Moving the catalyst horizontally increases contact between the catalyst and the stripping medium so that more hydrocarbons are removed from the catalyst. In these arrangements, the catalyst is given a labyrinthine path through a series of baffles located at different levels. Catalyst and gas contact is increased by this arrangement that leaves no open vertical path of significant cross-section through the stripping apparatus. Further examples of these stripping devices for FCC units are shown in U.S. Pat. No. 2,440,620; U.S. Pat. No. 2,612,438; U.S. Pat. No. 3,894,932; U.S. Pat. No. 4,414,100 and U.S. Pat. No. 4,364,905. These references show the typical stripping vessel arrangement having a stripping vessel, a series of outer baffles in the form of frusto-conical sections that direct the catalyst inwardly onto a series of inner baffles. The inner baffles are centrally located conical or frusto-conical sections that divert the catalyst outwardly onto the outer baffles. The stripping medium enters from below the lower baffles and continues rising upwardly from the bottom of one baffle to the bottom of the next succeeding baffle. Variations in the baffles include the addition of skirts about the trailing edge of the baffle as depicted in U.S. Pat. No. 2,994,659 and the use of multiple linear baffle sections at different baffle levels as demonstrated in FIG. 3 of U.S. Pat. No. 4,500,423. A variation in introducing the stripping medium is shown in U.S. Pat. No. 2,541,801 where a quantity of fluidizing gas is admitted at a number of discrete locations. Baffles can also include an upstanding weir on the edge of the baffle adjacent the downcomer.

Currently in stripping vessels for FCC units, the baffles are typically oriented to have an angle of 45° with respect to the horizontal. The sloped baffles assure that catalyst moves off the tray down to the next level in the stripping vessel. Sloped baffles generate a differential pressure head between holes that are lower in elevation on a baffle compared to the holes which are higher in elevation on the baffle. Because the pressure is going to be greater at lower elevations on the baffle, the velocity through the jets on the baffle will be greater at higher elevations on the baffle. Sloped baffles typically have several rows of holes near the bottom portion of the baffle. These trays perform well at low catalyst fluxes but have had very large stagnant zones occupying nearly two-thirds of the stripper vessel.

Residence time of catalyst in the stripper is expected to be a significant factor because the stripper is a secondary reactor where adsorbed heavy hydrocarbons undesirably continue to react producing coke and light hydrocarbons such as hydrogen, methane, ethane, ethylene, propane and propylene. The greater the amount of stagnant or dead zones, the greater the amount of heavy hydrocarbons that will continue to react.

U.S. Pat. No. 5,531,884 attempts to utilize a tubular downcomer near the central region of the baffle to improve flux capabilities. However, such tubular downcomers do not serve well to mix catalysts and stripping fluid but rather passes either one without mixing with the other at particular times resulting in a degradation of stripping efficiency.

US 2002/0008052 A1 improves the baffle configuration by spreading the holes out on the baffles such that equal gas is supplied to equal areas of the tray. This improvement all but eliminated the stagnant zones. The improved baffle exhibited very high flux capabilities with improved stripping performance at higher fluxes. However, at low fluxes, the improved baffle configuration performed with less or comparable efficiency than the conventional baffle with rows of holes near the bottom edge of the baffle in cold flow model evaluations. The provision of equal gas to equal areas of the baffle does not work in the case of low fluxes because there is insufficient catalyst momentum to sweep the bulk of the gas emitted from the openings in the baffle across the downcomer space to beneath the superjacent baffle.

Accordingly, it is an object of this invention to increase the efficiency of stripping in a baffle style stripper at low catalyst flux rates.

It is an additional objective of any new stripper design to minimize the amount of stagnant zones at low fluxes while maintaining the benefits of good catalyst stripping throughout the FCC process unit.

It is a further objective of this invention to decrease delta coke by more efficient catalyst stripping.

BRIEF SUMMARY OF THE INVENTION

It has now been found that providing a baffle-style stripper with openings configured to promote a greater volumetric flow rate of stripping medium to move through the bottom section of the baffle than through the top section of the baffle minimizes the generation of dead zones at low fluxes. Concentrating stripping medium flow nearer to the downcomer helps smaller fluxes of catalyst to sweep stripping media across the downcomer space to beneath the superjacent baffle. The horizontal movement of catalyst and stripping medium fosters efficient stripping.

For applications where the catalyst flux through the stripping zone is relatively low, the hole distribution arrangement of this invention provides substantial benefits. For lower flux applications, which typically refer to a flux below 90,000 lbs/hr/ft$^2$ (439,380 kg/hr/m$^2$) of stripper area, the catalyst flow across the stripping baffles tends to be greatest towards the lower portion of the baffles. Accordingly, a biasing of the stripping gas flow towards the lower portion of the baffle can particularly benefit low catalyst flux applications. In such cases, increasing the open hole area towards the lower portion of the baffle beyond that which would provide a uniform volumetric gas delivery across the baffle assures that a greater volumetric delivery of gas occurs over the lower portion of the sloped baffle.

Accordingly, in one embodiment, the present invention relates to a process for the stripping of entrained and/or adsorbed hydrocarbons from particulate material. The process comprises contacting particles with a hydrocarbon stream. Hydrocarbons are disengaged from the particles after contact with the hydrocarbon stream to produce a stream of contacted particles containing hydrocarbons. The contacted particles are then passed downwardly over a plurality of sloped stripping baffles, each baffle having a top section proximate a top edge of the baffle and a bottom section proximate a bottom edge of the baffle. The top section and the bottom section of the baffle are demarcated by an imaginary line extending laterally on the baffle and substantially parallel to one of the top edge, the bottom edge and an imaginary line bifurcating the baffle into equal areas. The top section and the bottom section of the baffle each also include a plurality of openings. A stripping fluid is discharged upwardly through the openings of the baffles such that a volumetric flow rate of stripping fluid moving through the bottom section of the baffle is greater than a volumetric flow rate of stripping fluid moving through the top section of the baffle. The stripping fluid strips hydrocarbons from the particulate material. Stripping fluid, stripped hydrocarbons and stripped particles are then recovered from the stripping baffles.

In another embodiment, the present invention relates to an apparatus for the stripping of entrained and/or adsorbed hydrocarbons from particulate material. The apparatus comprises a stripping vessel and at least one port defined by the stripping vessel for receiving particles that contain entrained or adsorbed hydrocarbons from the contact of the particles with a hydrocarbon stream and for withdrawing stripping fluid and stripped hydrocarbons from the stripping vessel. A plurality of sloped stripping baffles is spaced apart vertically over at least a portion of the stripping vessel height with each baffle having a sloped surface. Each baffle has a top section proximate a top edge of the baffle and a bottom section proximate a bottom edge of the baffle. The top section and the bottom section are demarcated by an imaginary line extending laterally on the baffle and substantially parallel to one of the top edge, the bottom edge and an imaginary line bifurcating the baffle into equal areas. A plurality of openings is on the top section of the baffle, and a plurality of openings is on the bottom section of the baffle. A ratio of the total area of openings to the area of the section of the baffle is greater in the bottom section of the baffle than in the top section of the baffle. The apparatus also comprises at least one fluid inlet for passing a stripping fluid to the underside of at least one stripping baffle for stripping hydrocarbons from the particulate material, and at least one particle outlet for recovering stripped particles from the stripping baffles.

In a further embodiment, the present invention relates to a process for the stripping of entrained and/or adsorbed hydrocarbons from particulate material, wherein the entrained and/or adsorbed hydrocarbons are from the fluidized catalytic cracking (FCC) of an FCC feed with a particulate material comprising an FCC catalyst. The process comprises contacting an FCC feed with FCC catalyst to provide a mixture of FCC catalyst and FCC feed and to convert the FCC feed while depositing coke on the FCC catalyst. Converted FCC feed is disengaged from the FCC catalyst to produce a stream of disengaged catalyst particles containing hydrocarbons. The disengaged catalyst particle stream is passed into a stripping zone, and the stream of catalyst particles is passed downwardly over a plurality of vertically sloped stripping baffles in the stripping zone. Each baffle has a top section proximate a top edge of the baffle and a bottom section proximate a bottom edge of the baffle. The top section and the bottom section are demarcated by an imaginary line extending laterally on the baffle and substantially parallel to one of the top edge, the bottom edge and an imaginary line bifurcating the baffle into equal areas. A stripping fluid is discharged upwardly through a plurality of openings in the top section of the baffle and a plurality of openings in the bottom section of the baffle. The openings are distributed to provide a greater volumetric flow rate of stripping fluid to the lower portion of the sloped surface than to the upper portion of the sloped surface. Stripping fluid and stripped hydrocarbons that pass upwardly from the stripping baffles are recovered. Stripped FCC catalyst that passes downwardly from the stripping baffles is recovered. Stripped FCC catalyst is passed to a regeneration zone to remove coke from the FCC catalyst. FCC catalyst is then returned from the regeneration zone for contact with the FCC feed.

Additional objects, embodiments, and details of this invention are given in the following detailed description of the invention.

DETAILED DESCRIPTION OF THE INVENTION

Figure 1:
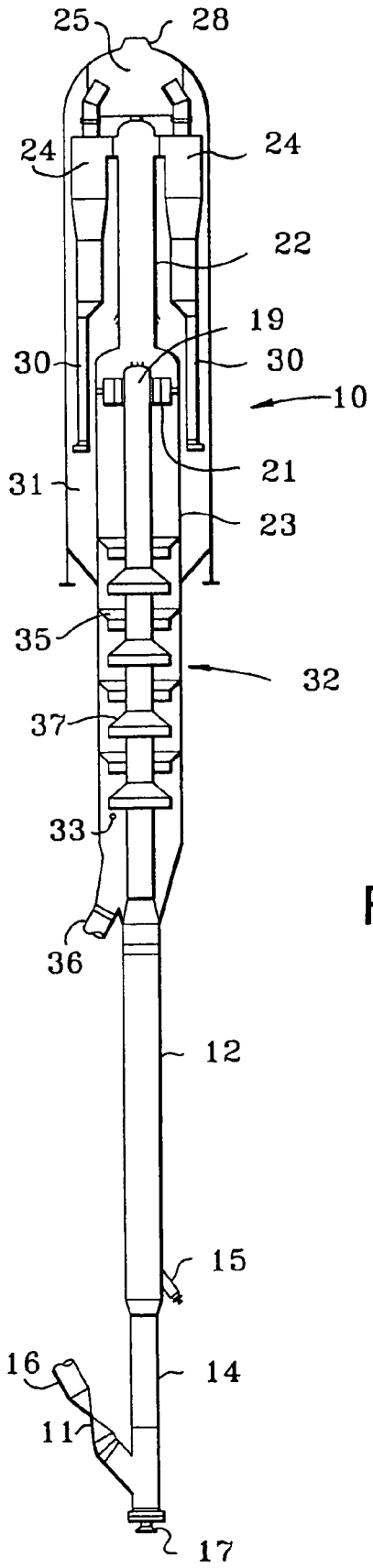
FIG. 1 shows a sectional elevation view of an FCC reactor and stripper arrangement in which the present invention may be incorporated.

Looking first at a more complete description of the FCC process, the typical feed to an FCC unit is a gas oil such as a light or vacuum gas oil. Other petroleum-derived feed streams to an FCC unit may comprise a diesel boiling range mixture of hydrocarbons or heavier hydrocarbons such as reduced crude oils. It is preferred that the feed stream consists of a mixture of hydrocarbons having boiling points, as determined by the appropriate ASTM test method, above about 446° F. (230° C.) and more preferably above about 554° F. (290° C.). It is becoming customary to refer to FCC-type units which are processing heavier feedstocks, such as atmospheric reduced crudes, as residual crude cracking units, or resid cracking units. The process and apparatus of this invention can be used for either FCC or residual cracking operations. For convenience, the remainder of this specification will only make reference to the FCC process.

An FCC process unit comprises a reaction zone and a catalyst regeneration zone. In the reaction zone, a feed stream is contacted with a finely divided fluidized catalyst maintained at an elevated temperature and at a moderate positive pressure. In this invention, contacting of feed and catalyst usually takes place in a riser conduit, but may occur in any effective arrangement such as the known devices for short contact time contacting. In the case of a riser, it comprises a principally vertical conduit as the main reaction site, with the effluent of the conduit emptying into a large volume process vessel, which is called the reactor vessel or may be referred to as a separation vessel. The residence time of catalyst and hydrocarbons in the riser needed for substantial completion of the cracking reactions is only a few seconds or less. The flowing vapor/catalyst stream leaving the riser may pass from the riser to a solids-vapor separation device located within the separation vessel or may enter the separation vessel directly without passing through an intermediate separation apparatus. When no intermediate apparatus is provided, much of the catalyst drops out of the flowing vapor/catalyst stream as the stream leaves the riser and enters the separation vessel. One or more additional solids/vapor separation devices, almost invariably a cyclone separator, is normally located within and at the top of the large separation vessel. The products of the reaction are separated from a portion of catalyst which is still carried by the vapor stream by means of the cyclone or cyclones and the vapor is vented from the cyclone and separation zone. The spent catalyst falls downward to a lower location within the separation vessel. A stripper is usually located near a lower part of the reactor vessel to remove hydrocarbons from the catalyst and comprises a stripper vessel separate from the riser and reactor vessel. Catalyst is transferred to a separate regeneration zone after it passes through the stripping apparatus.

The rate of conversion of the feedstock within the reaction zone is controlled by regulation of the temperature, activity of the catalyst, and quantity of the catalyst (i.e., catalyst-to-oil ratio) maintained within the reaction zone. The most common method of regulating the temperature in the reaction zone is by regulating the rate of circulation of catalyst from the regeneration zone to the reaction zone, which simultaneously changes the catalyst-to-oil ratio. That is, if it is desired to increase the conversion rate within the reaction zone, the rate of flow of catalyst from the regeneration zone to the reaction zone is increased. This results in more catalyst being present in the reaction zone for the same volume of oil charged thereto. Since the temperature within the regeneration zone under normal operations is considerably higher than the temperature within the reaction zone, an increase in the rate of circulation of catalyst from the regeneration zone to the reaction zone results in an increase in the reaction zone temperature.

The chemical composition and structure of the feed to an FCC unit will affect the amount of coke deposited upon the catalyst in the reaction zone. Normally, the higher the molecular weight, Conradson carbon, heptane insolubles, and carbon-to-hydrogen ratio of the feedstock, the higher will be the coke level on the spent catalyst. Also, high levels of combined nitrogen, such as found in shale-derived oils, will increase the coke level on spent catalyst. Processing of heavier feedstocks, such as deasphalted oils or atmospheric bottoms from a crude oil fractionation unit (commonly referred to as reduced crude) results in an increase in some or all of these factors and therefore causes an increase in the coke level on spent catalyst. As used herein, the term "spent catalyst" is intended to indicate catalyst employed in the reaction zone which is being transferred to the regeneration zone for the removal of coke deposits. The term is not intended to be indicative of a total lack of catalytic activity by the catalyst particles. The term "used catalyst" is intended to have the same meaning as the term "spent catalyst".

The reaction zone, which is normally referred to as a "riser" due to the widespread use of a vertical tubular conduit, is maintained at high temperature conditions which generally include a temperature above about 797° F. (425° C.). Preferably, the reaction zone is maintained at cracking conditions which include a temperature of from about 896° to 1094° F. (480° to about 590° C.) and a pressure of from about 9.4 to 72.5 psia (65 to 500 kPa) but preferably less than about 39.9 psia (275 kPa). The catalyst-to-oil ratio, based on the weight of catalyst and feed hydrocarbons entering the bottom of the riser, may range up to 20:1 but is preferably between about 4:1 and about 10:1. Hydrogen is not normally added to the riser, although hydrogen addition is known in the art. On occasion, steam may be passed into the riser. The average residence time of catalyst in the riser is preferably less than about 5 seconds. The type of catalyst employed in the process may be chosen from a variety of commercially available catalysts. A catalyst comprising a zeolite base material is preferred, but the older style amorphous catalyst can be used if desired. Further information on the operation of FCC reaction zones may be obtained from U.S. Pat. No. 4,541,922, U.S. Pat. No. 4,541,923 and the patents cited above.

In an FCC process, catalyst is continuously circulated from the reaction zone to the regeneration zone and then again to the reaction zone. The catalyst therefore acts as a vehicle for the transfer of heat from zone to zone as well as providing the necessary catalytic activity. Any FCC catalyst can be used for the process. The particles will typically have a size of less than 100 microns. Catalyst which is being withdrawn from the regeneration zone is referred to as "regenerated" catalyst. As previously described, the catalyst charged to the regeneration zone is brought into contact with an oxygen-containing gas such as air or oxygen-enriched air under conditions which result in combustion of the coke. This results in an increase in the temperature of the catalyst and the generation of a large amount of hot gas which is removed from the regeneration zone as a gas stream referred to as a flue gas stream. The regeneration zone is normally operated at a temperature of from about 1112° F. (600° C.) to about 1472° F. (800° C.). Additional information on the operation of FCC reaction and regeneration zones may be obtained from U.S. Pat. No. 4,431,749, U.S. Pat. No. 4,419,221 (cited above) and U.S. Pat. No. 4,220,623.

The catalyst regeneration zone is preferably operated at a pressure of from about 5.1 to 72.5 psia (35 to 500 kPa). The spent catalyst being charged to the regeneration zone may contain from about 0.2 to about 15 wt-% coke. This coke is predominantly comprised of carbon and can contain from about 3 to 12 wt-% hydrogen, as well as sulfur and other elements. The oxidation of coke will produce the common combustion products: carbon dioxide, carbon monoxide, and water. As known to those skilled in the art, the regeneration zone may take several configurations, with regeneration being performed in one or more stages. Further variety is possible due to the fact that regeneration may be accomplished with the fluidized catalyst being present as either a dilute phase or a dense phase within the regeneration zone. The term "dilute phase" is intended to indicate a catalyst/gas mixture having a density of less than 18.7 lb/ft$^3$ (300 kg/m$^3$). In a similar manner, the term "dense phase" is intended to mean that the catalyst/gas mixture has a density equal to or more than 18.7 lb/ft$^3$ (300 kg/m$^3$). Representative dilute phase operating conditions often include a catalyst/gas mixture having a density of about 0.9 to 9.4 lb/ft$^3$ (15 to 150 kg/m$^3$).

FIG. 1 shows an FCC unit 10 to which the method of this invention may be applied. The FCC arrangement represents only one of many FCC arrangements to which this invention can be applied. Looking then at FIG. 1, a regenerator standpipe 16 transfers catalyst from a regenerator (not shown) at a rate regulated by a slide valve 11. A fluidization medium from a nozzle 17 transports catalyst upwardly through a lower riser portion 14 at a relatively high density until a plurality of feed injection nozzles 15 (only one is shown) inject feed across the flowing stream of catalyst particles. The resulting mixture continues upward through an upper riser portion 12 until a pair of disengaging arms 21 tangentially discharge the mixture of gas and catalyst from a top 19 of the riser into a disengaging chamber 23 that effects separation of gases from the catalyst. A transport conduit 22 carries the hydrocarbon vapors and entrained catalyst to one or more cyclones 24 that separates spent catalyst from the hydrocarbon vapor stream. A collection chamber 25 gathers the separated hydrocarbon vapor streams from the cyclones for passage to an outlet nozzle 28 and into a fractionation zone (not shown). Diplegs 30 discharge catalyst from the cyclones 24 into a lower portion of a collection space 31 that eventually passes the catalyst and adsorbed or entrained hydrocarbons into a stripping section 32 across ports (not shown) defined by the bottom of the disengaging chamber 23. Catalyst separated in the disengaging chamber 23 passes directly into the stripping section 32. The stripping gas such as steam enters a lower portion of the stripping section 32 through the inlets 33 and rises counter-current to a downward flow of catalyst through the stripping section 32, thereby removing adsorbed and entrained hydrocarbons from the catalyst which flow upwardly through and are ultimately recovered with the steam by the cyclones 24. The inlets 33 may supply the stripping gas to one or more distributors (not shown) that distribute the gas around the circumference of the baffle. In order to facilitate hydrocarbon removal, a series of downwardly sloping outer and inner baffles 35 and 37, respectively, are provided in the stripping section 32. The spent catalyst leaves the stripping section 32 through a reactor conduit 36 and passes into the regeneration zone. The catalyst is regenerated in the regeneration zone as is known in the art and sent back to the lower riser portion 14 through the regenerator standpipe 16.

Figure 2:
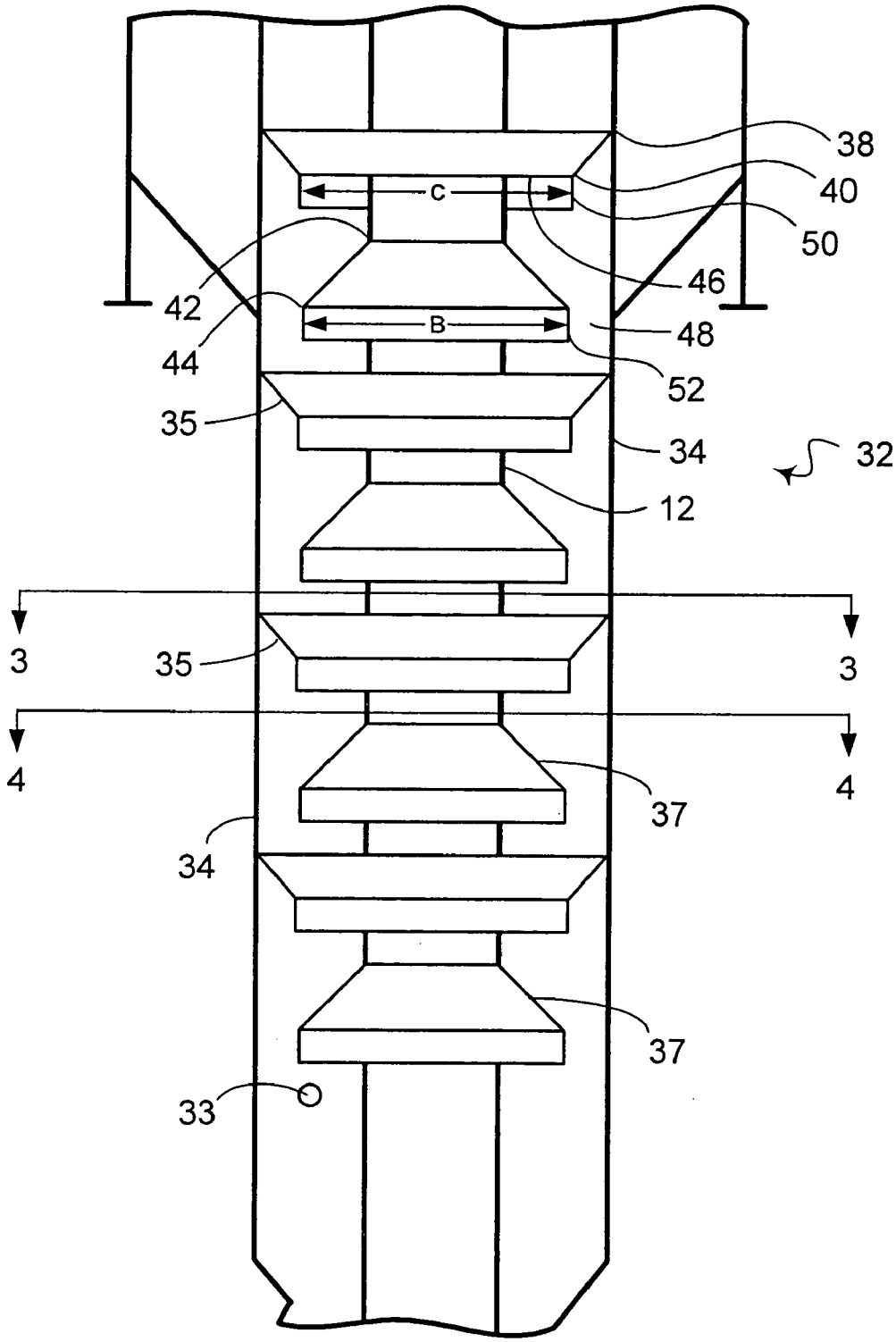
FIG. 2 is an enlarged section of the stripper section taken from FIG. 1.

FIG. 2 is an enlarged partial view of the stripping vessel or section 32 in FIG. 1. The sloped outer and inner baffles 35 and 37, respectively, have a generally annular projection across the transverse cross-section of the stripping section 32. The inner baffles 37 extend outwardly from the upper riser portion 12. The outer baffles 35 extend inwardly from a wall 34 of the stripping section 32. The baffles 35, 37 extend down the vertical length of the stripping section 32 for a substantial portion of its vertical length. Increased stripper performance is usually obtained with an increased number of baffles. The available length of the stripper for layout configurations or other equipment constraints may limit the number of baffles that may be incorporated into the stripper. The annular baffle configuration is generally preferred since it will maximize the number of baffles which may be located within the stripping section. Additional baffles represent additional stages of stripping and most strippers will usually have a minimum of seven baffles overall. Spacing between the baffles must provide sufficient flow area for cascading movement of the catalyst around the inner and outer baffles. Providing a slope to the projecting baffle surface ensures movement of the catalyst across the baffle surface. Generally, the baffles will have an angle of inclination to the horizontal of between 30° and 45°. Shallower angles of the baffles have the advantage of further maximizing the number of baffles that may be located in a given stripper length and providing less differential in the pressure head between the holes closer to the top edge and the holes closer to the bottom edge.

The outer baffle 35 extends from a top edge 38 to a bottom edge 40, and the inner baffle 37 extends from a top edge 42 to a bottom edge 44. The space between the bottom edge 40 of the outer baffle 35 and an outer surface of the upper riser portion 12 defines a downcomer section 46 for the outer baffle 35. The space between the bottom edge 44 of the inner baffle 37 and the inner surface of the wall 34 of the stripping section 32 defines a downcomer section 48 for the inner baffle 37. Catalyst cascades from baffle to baffle through the downcomer sections 46, 48.

An outer diameter B of the inner baffles 37 and an inner diameter C of the outer baffles 35 are sized to facilitate construction of the stripper internals and to balance catalyst flow areas. Accordingly, dimensions B and C are ordinarily set so that the transverse projection of the inner and outer baffles cover approximately an equal area. Maintaining the outer diameter B slightly smaller than the inner diameter C permits insertion of the upper riser portion 12 with the inner baffles 37 assembled thereon with adequate clearance through the stripping section 32 with outer baffles assembled therein. The difference in diameters B and C is kept relatively small and it is preferable that each baffle covers at least one-third of the total transverse annular flow area of the stripping section 32. Preferably, the combined transverse projection of the inner and outer baffles will have a projection that substantially covers the annular cross-section of the stripper.

The outer baffles 35 and the inner baffles 37 each show vertical skirts 50 and 52, respectively, depending from the bottom edges 40, 44 of the sloped baffle. The vertical skirts 50, 52 can serve a variety of purposes. The skirt has a length which may vary from a minimal amount necessary to provide structural stability to the edge of the baffle to longer calculated lengths to provide a desired increase in the pressure drop across the holes in the sloped portion of the baffle. In this regard, as a stripping medium rises from the inlet 33, it passes first to the underside of the next higher baffle and displaces catalyst from the volume underneath the baffle. Displacement of catalyst from the underside of the baffle by the entering stripping medium will continue until the volumetric discharge of stripping medium through the openings exceeds the addition of stripping medium. For subsequently higher baffles the discharge of stripping medium and displaced vapors through the openings equals the rate at which gas continues to flow into the bottom of the baffle. When the stripping medium, or a stripping medium and displaced vapors, exceeds the volumetric discharge of gas across the openings in the baffles, the entering gas will displace catalyst from the entire volume beneath the baffle with any excess gas passing under the baffle or skirt if so provided. Accordingly, the pressure differential across any particular opening is equal to the density of the catalyst multiplied by the elevation of the hole relative to the level of catalyst beneath that hole or opening. Accordingly, increasing the length of the skirt can raise the pressure drop across individual openings.

An important feature of this invention is the distribution of openings on the baffle to provide a greater volumetric flow rate of stripping medium through openings in the bottom of the baffle compared to the top. This invention is particularly useful for low catalyst flux operation where catalyst wends through the stripper closer to the downcomers. Low catalyst flux rates are typically lower than 90,000 kg/hr/ft$^2$ (439,380 kg/hr/m$^2$) and preferably lower than 60,000 kg/hr/ft$^2$ (292,920 kg/hr/m$^2$). Consequently, the invention concentrates the stripping medium nearer to the flow path of the catalyst.

The distribution of openings on the baffles 35 and 37 will be described with reference to FIGS. 3 and 4. Although the baffles 35, 37 in FIGS. 3 and 4 are annular-type sloped baffles, which are preferred, other baffle configurations such as side-to-side baffles may also incorporate the present invention.

Figure 3:
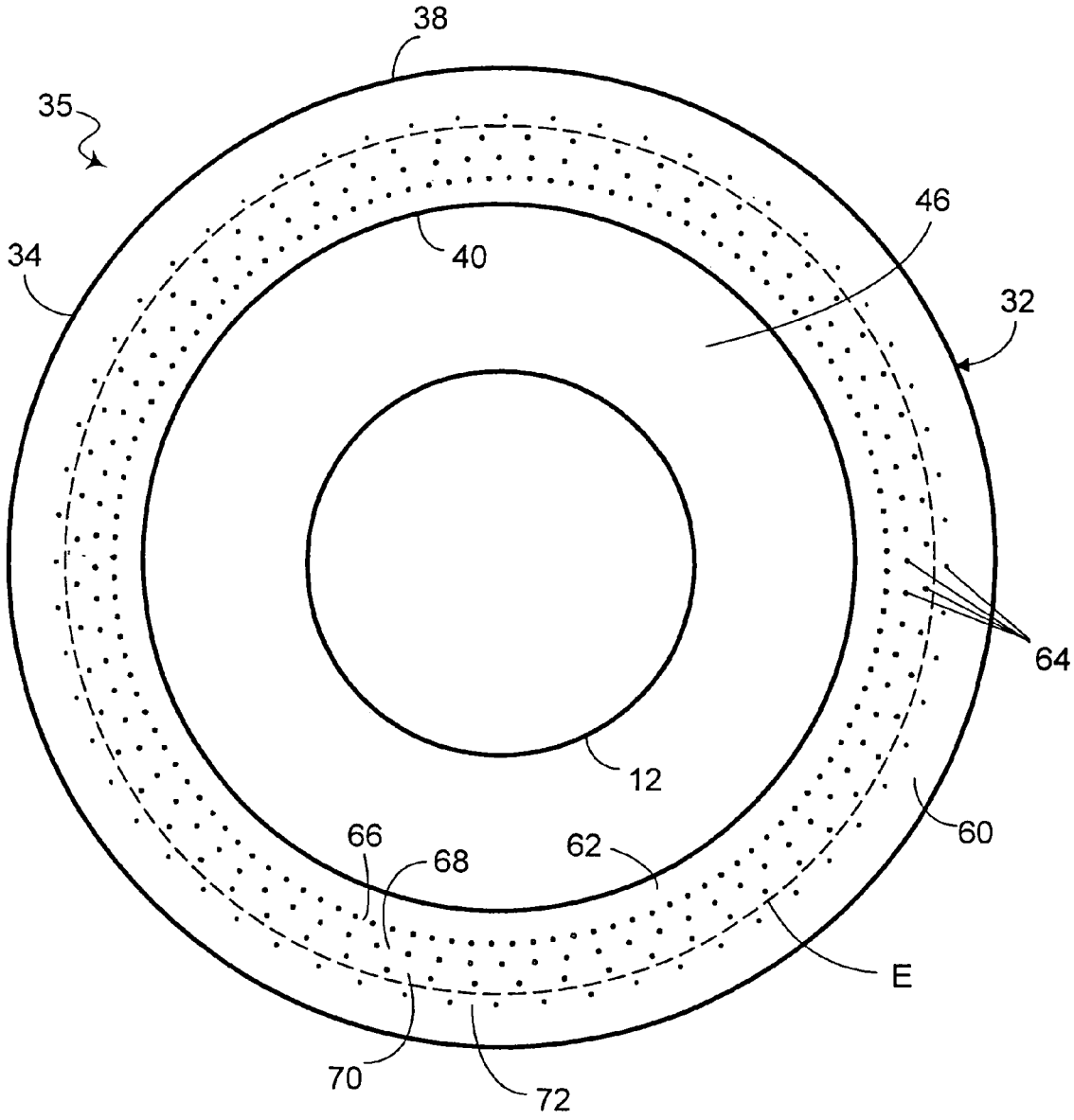
FIG. 3 is a sectional view taken along segment 3—3 of FIG. 2 that shows an outer stripper baffle of the present invention.
Figure 4:
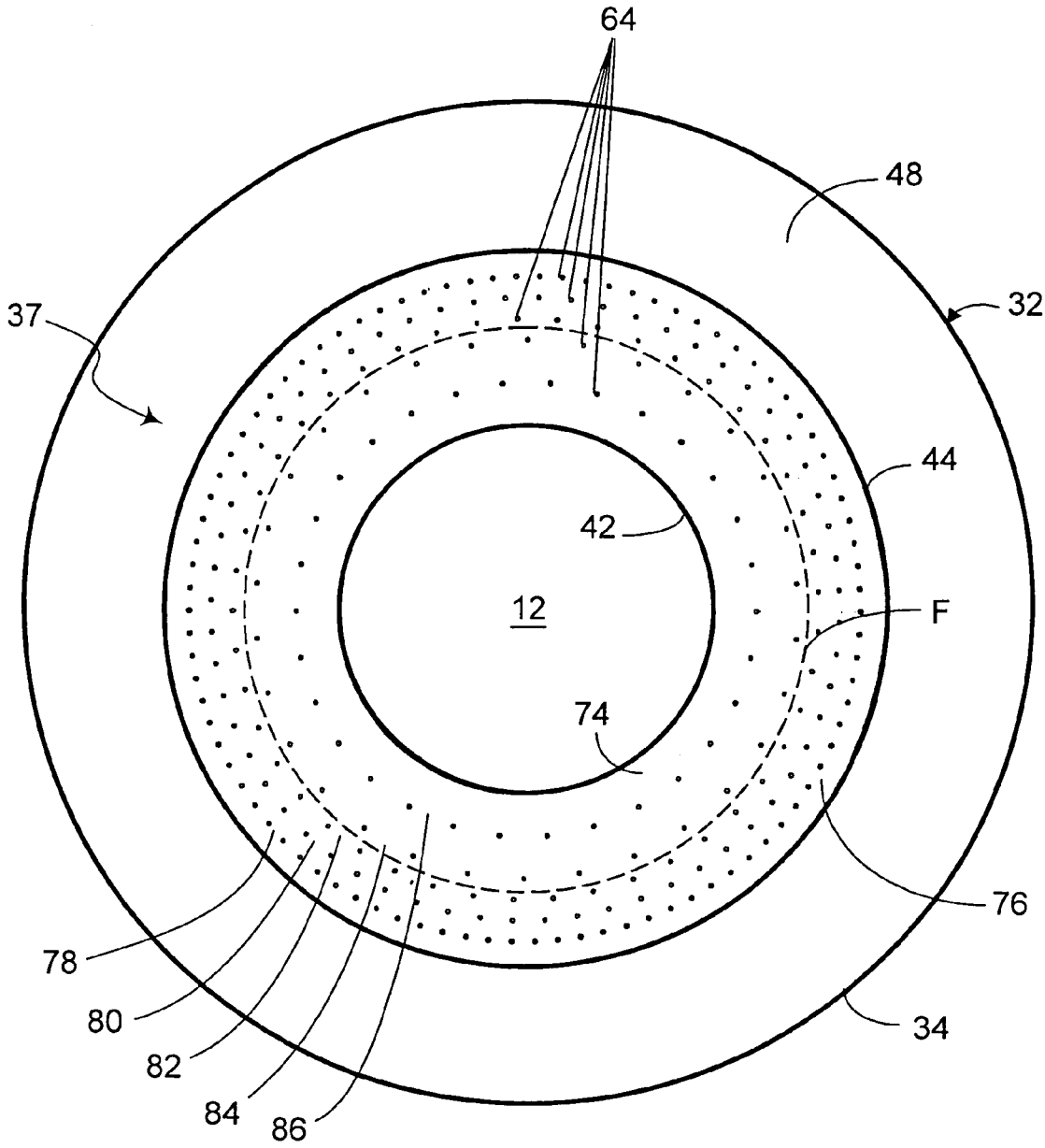
FIG. 4 is a sectional view taken along segment 4—4 of FIG. 2 that shows an inner stripper baffle of the present invention.

FIG. 3 is a sectional view of the stripping section 32 that gives a plan view of the outer baffle 35. The subjacent inner baffle 37 is not shown in FIG. 3 for purposes of clarity. The outer baffle 35 extends from the top edge 38 which is fastened to the internal surface of the wall 34 of the stripping section 32 at a downward slope to the bottom edge 40. The skirt 50 is not visible in FIG. 3. The outer baffle 35 surrounds the upper riser portion 12. The bottom edge 40 of the outer baffle 35 and the outer surface of the upper riser portion 12 define the downcomer section 46 through which catalyst cascades to the subjacent inner baffle 37. An imaginary line E extending laterally around the outer baffle 35 and substantially parallel to the top edge 38, the bottom edge 40 and/or an imaginary line that bifurcates the outer baffle 35 into equal areas demarks a boundary between a top section 60 near the top edge 38 and a bottom section 62 near the bottom edge 40 of the outer baffle 35. It should be noted that the imaginary lines may be straight or curved as shown in FIG. 3. The imaginary line E may be set to intersect the mid-point of the shortest imaginary line between the top edge 38 and the bottom edge 40 of the baffle. The imaginary line E is preferably set to bifurcate the top and bottom sections 60, 62 into equal areas. Hence, the imaginary line E is an example of an imaginary line that bifurcates the outer baffle 35 into equal areas. However, the demarkation between the top and bottom sections of the baffle may vary in position on different baffles incorporating the present invention. The top section 60 and the bottom section 62 of the outer baffle 35 both contain a plurality of openings 64 for allowing stripping gas such as steam to permeate and fluidize the top side of the baffle. The openings 64 are distributed in the top and bottom sections 60, 62 of the baffle such that a volumetric flow rate of stripping fluid moving through the bottom section 62 of the outer baffle 35 is greater than a volumetric flow rate of stripping fluid moving through the top section 60 of the baffle.

One way to provide for this flow rate distribution is to design the ratio of total area of the openings to the total area of the bottom section 62 of the baffle greater than the ratio of total area of the openings in the top section 60 of the baffle to the total area of the top section 60 of the baffle. If the dimensions of the openings 64 are uniform, this can be achieved by placing the openings in the bottom section 62 of the baffle closer to each other than the openings in the top section 60 of the baffle on average. However, an important design factor is that the velocity of stripping medium through holes higher up on the sloped baffle, that is through the top section 60, will be greater than through openings in the bottom section 62. This is a consequence of pressure decreasing proportionately with height in the stripping section 32. Therefore, the velocity differential along the elevation of the baffle must be taken into account when configuring that hole pattern. Consequently, the ratio of total area of the openings 64 to the total area of the section of the outer baffle 35 must be greater for the bottom section 62 than for the top section 60 by a margin sufficient to account for the velocity differential. Some or all of the openings in the top section 60 of the baffle 35 may be fashioned with a relatively smaller diameter than the openings in the bottom section 62 to account for the velocity differential and accomplish the desired volumetric flow rate distribution of the present invention.

Specifically, in FIG. 3, there are three rows 66, 68 and 70 of the openings 64 in the bottom section 62 of the baffle. Whereas, there is only one row 72 of the openings 64 in the top section 60 of the baffle. However, other patterns of openings may embody the present invention. There are more openings 64 in the bottom section 62 than in the top section 60 of the baffle, and the openings are on average closer to each other in the bottom section 62 of the baffle than in the top section 60 of the baffle. Accordingly, there is a greater ratio of total area of the openings 64 per total area of the section in the bottom section 62 of the baffle than in the top section 60 of the baffle and by a sufficient margin to maintain the volumetric flow rate of stripping medium through the bottom section 62 greater than in the top section 60 of the outer baffle 35. The imaginary line E and the rows 66, 68, 70 and 72 of the openings 64 are substantially parallel to the top edge 38 and the bottom edge 40 of the baffle. In FIG. 3, the imaginary line E does not intersect any of the openings 64. To assure even fluidization at the top section 60 of the baffle, particularly when there is more than one row of holes in the top section of the baffle, it is preferable to space the holes in each row the same distance away from each other as the distance between rows of holes. It may be preferable to space all of the openings 64 this way. This distribution pattern, however, is not shown in the FIGURES.

FIG. 4 is a sectional view of the stripping section 32 that gives a plan view of the inner baffle 37. The subjacent outer baffle 35 is not shown in FIG. 4 for purposes of clarity. The inner baffle 37 extends from the top edge 42 which is fastened to the external surface of the upper riser portion 12 at a downward slope to the bottom edge 44. The skirt 52 is not visible in FIG. 4. The inner baffle 37 surrounds the upper riser portion 12. The bottom edge 44 of the inner baffle 37 and the inner surface of the wall 34 define the downcomer section 48 through which catalyst cascades to the subjacent outer baffle 35. An imaginary line F extending laterally around the inner baffle 37 and substantially parallel to the top edge 42, the bottom edge 44 or an imaginary line that bifurcates the inner baffle 37 into equal areas demarks a boundary between a top section 74 near the top edge 42 and a bottom section 76 near the bottom edge 44 of the inner baffle 37. Again the imaginary lines may be straight or curved as shown in FIG. 4. The imaginary line F may be set to intersect the mid-point of the shortest imaginary line between the top edge 42 and the bottom edge 44 of the baffle. The imaginary line F is preferably set to bifurcate the top and bottom sections 74, 76 into equal areas. Hence, the imaginary line F is an example of an imaginary line that bifurcates the inner baffle 37 into equal areas. However, the demarkation between the top and bottom sections 74, 76 of the inner baffle 37 may vary in position on different baffles incorporating the present invention. The top section 74 and the bottom section 76 of the inner baffle 37 both contain a plurality of the openings 64 for allowing stripping gas such as steam to permeate and fluidize the top side of the inner baffle 37. The openings 64 are distributed in the top and bottom sections 74, 76 of the inner baffle 37 such that a volumetric flow rate of stripping fluid moving through the bottom section 76 of the inner baffle 37 is greater than a volumetric flow rate of stripping fluid moving through the top section 74 of the baffle.

Like the outer baffle 35, one way to provide for this flow rate distribution is to design the ratio of total area of the openings to the total area of the section in the bottom section 76 of the baffle greater than the top section 74 of the baffle. If the dimensions of the openings 64 are uniform, this can be achieved by placing the openings in the bottom section 76 of the baffle closer to each other than the openings in the top section 74 of the baffle on average. However, the velocity of stripping medium through holes higher up on the baffle, that is through the top section 74, will be greater than through openings in the bottom section 76. Consequently, the ratio of total area of the openings 64 to the total area of the section of the inner baffle 37 must be greater for the bottom section 76 than for the top section 74 by a margin sufficient to account for the velocity differential. Some or all of the openings in the top section 74 of the baffle 37 may be fashioned with a relatively smaller diameter than the openings in the bottom section 76 to account for the velocity differential and accomplish the desired volumetric flow rate distribution of the present invention.

Specifically, in FIG. 4, there are three rows 78, 80 and 82 of the openings 64 in the bottom section 76 of the baffle. Whereas, there are only two rows 84 and 86 of the openings 64 in the top section 74 of the baffle. Other patterns of openings 64 may incorporate the present invention. There are more openings 64 in the bottom section 76 than in the top section 74 of the inner baffle 37 and the openings are on average closer to each other in the bottom section 76 of the baffle than in the top section 74 of the baffle. Accordingly, there is a greater ratio of total area of the openings 64 per total area of the section in the bottom section 76 of the inner baffle 37 than in the top section 74 of the baffle by a sufficient margin to maintain the volumetric flow rate of stripping medium through the bottom section 76 greater than in the top section 74 of the inner baffle 37. The imaginary line F and the rows 78, 80, 82, 84 and 86 of the openings 64 are substantially parallel to the top edge 38 and the bottom edge 40 of the baffle. To assure even fluidization at the top section 74 of the baffle, particularly when there is more than one row of holes in the top section of the baffle, it is preferable to space the holes in each row the same distance away from each other as the distance between rows of holes. It may be preferable to space all of the openings 64 this way. This distribution pattern, however, is not shown in the FIGURES.

The openings 64 may be formed by simply drilling holes through the base material of the baffles 35, 37. The baffles are typically formed from alloy steels that will stand up to the high temperature conditions in the reaction zone. Such steels are often subject to erosion and the baffles may benefit from the use of inserts or nozzles to define the openings and provide resistance to the erosive conditions imposed by the circulation of catalyst over the top of the baffle. Furthermore, the baffles are routinely covered with a refractory material that provides additional erosion resistance. Details of abrasion-resistant nozzles and refractory linings are well known to those skilled in the art of particle transport. Lastly, the lowest baffle in the stripper section may be fashioned with less openings to account for the lower temperature of the inlet stripping fluid.

EXAMPLE 1

We believe that the ratio of volume of stripping medium through respective sections of the baffle is dependent upon catalyst flux rate. The following Table shows preferred ratios of volume of stripping medium distributed through top and bottom sections of the baffle at given catalyst flux rates. This data is premised on the demarking line bifurcating the top section and the bottom section of the baffle into equal areas.

| Catalyst Flux Rate (lbs/hr/ft$^2$) | Catalyst Flux Rate (kg/hr/m$^2$) | Preferred Percentage of Volume of Stripping Fluid Through Top Section of Baffle (%) | Preferred Percentage of Volume of Stripping Fluid Through Bottom Section of Baffle (%) |
|---|---|---|---|
| 15,000 | 73,230 | 10–15 | 85–90 |
| 30,000 | 146,460 | 15–20 | 80–85 |
| 40,000 | 195,280 | 20–25 | 75–80 |
| 50,000 | 244,100 | ~35 | ~65 |
| 60,000 | 292,920 | ~45 | ~55 |

EXAMPLE 2

Baffles similar to the outer baffle 35 and the inner baffle 37 depicted in FIGS. 3 and 4, respectively, were designed to have the following performance when installed in a stripper section such as stripper section 32 shown in FIGS. 1 and 2. The opening diameter was designed to be 1.3 cm (0.5 inches) except for the top row of openings in each baffle in which the opening diameter was designed to be 1.0 cm (0.375 inches).

| Outer Baffle 35 | | | |
|---|---|---|---|
| Row of Openings (FIG. 3) | Number of Openings per Row | Ratio of Total Area of Openings to Baffle Section per Row | Total Volumetric Flow Rate per Row (m$^3$/s (ft$^3$/s)) |
| 72 | 60 | 0.0021 | 0.225 (7.91) |
| 70 | 60 | 0.0029 | 0.336 (11.86) |
| 68 | 80 | 0.0039 | 0.349 (12.32) |
| 66 | 120 | 0.0058 | 0.306 (10.79) |

The ratio of total area of openings to area of baffle section in top section 60 including just row 72 is 0.0021 which is less than the same ratio of 0.0387 for bottom baffle section 62 including rows 66, 68 and 70. The total volumetric flow rate of row 72 of openings in top section 60 is 0.225 m$^3$/s (7.91 ft$^3$/s) which is less than the total volumetric flow rate of 0.991 m$^3$/s (34.97 ft$^3$/s) in rows 66, 68 and 70 of openings in bottom section 62.

| Inner Baffle 37 | | | |
|---|---|---|---|
| Row of Openings (FIG. 4) | Number of Openings per Row | Ratio of Total Area of Openings to Baffle Section per Row | Total Volumetric Flow Rate per Row (m$^3$/s (ft$^3$/s)) |
| 86 | 30 | 0.0012 | 0.144 (5.06) |
| 84 | 30 | 0.0021 | 0.206 (7.28) |
| 82 | 45 | 0.0029 | 0.268 (9.44) |
| 80 | 60 | 0.0039 | 0.288 (10.14) |
| 78 | 90 | 0.0059 | 0.292 (10.30) |

The ratio of total area of openings to area of baffle section in top section 74 including rows 84 and 86 is 0.0033 which is less than the same ratio of 0.0127 for bottom baffle section 76 including rows 78, 80 and 82. The total volumetric flow rate of rows 86 and 84 of openings in top section 74 is 0.350 m$^3$/s (12.34 ft$^3$/s) which is less than the total volumetric flow rate of 0.848 m$^3$/s (29.88 ft$^3$/s) in rows 82, 80 and 78 of openings in bottom section 76.

What is claimed is:

1. An apparatus for the stripping of entrained and/or adsorbed hydrocarbons from particulate material, said apparatus comprising:

a stripping vessel;

at least one port defined by the stripping vessel for receiving particles that contain entrained or adsorbed hydrocarbons from the contact of the particles with a hydrocarbon stream and for withdrawing stripping fluid and stripped hydrocarbons from the stripping vessel;

a plurality of sloped stripping baffles spaced apart vertically over at least a portion of the stripping vessel height with each baffle of said plurality of sloped stripping baffles having a sloped surface, each baffle having a top section proximate a top edge of said baffle and a bottom section proximate a bottom edge of said baffle, said top section and said bottom section being demarcated by a first imaginary line extending laterally on said baffle and substantially parallel to one of a group consisting of said top edge, said bottom edge and a second imaginary line bifurcating said baffle into equal areas;

a plurality of openings on the top section of said baffle and a plurality of openings on the bottom section of said baffle, a ratio of the total area of openings in the bottom section to the area of the bottom section of said baffle being greater than a ratio of the total area of openings in the top section to the area of the top section of said baffle and an average distance between adjacent openings is smaller in the bottom section of the baffle than in the top section of the baffle;

at least one fluid inlet for passing a stripping fluid to the underside of at least one stripping baffle for stripping hydrocarbons from the particulate material; and at least one particle outlet for recovering stripped particles from the stripping baffles.

2. The apparatus of claim 1 wherein said at least one port comprises a single opening at the top of the stripping vessel for receiving particles and withdrawing stripping fluid.

3. The apparatus of claim 1 wherein each stripping baffle has a transverse projection equal to at least one-third of the minimum transverse cross-section of the stripping vessel at that baffle location.

4. The apparatus of claim 1 wherein a total area of openings in ten bottom section is greater than in the top section of said baffle.

5. The apparatus of claim 1 wherein openings in the bottom section and top section of said baffle are distributed in rows substantially parallel to one af said top and bottom edges.

6. The apparatus of claim 1 wherein the first imaginary line bifurcates said baffle into equal areas.

* * * * *